US006533035B2

(12) United States Patent
Troutt et al.

(10) Patent No.: US 6,533,035 B2
(45) Date of Patent: Mar. 18, 2003

(54) METHOD AND APPARATUS FOR STIMULATING WELL PRODUCTION

(75) Inventors: James Troutt, Burlington, KY (US); Millard Lewis, Sellersburg, IN (US); Robert A. Ereth, Redlands, CA (US)

(73) Assignee: Layne Christensen Company, Mission Woods, KS (US)

( * ) Notice: Subject to any disclaimer, the term of this patent is extended or adjusted under 35 U.S.C. 154(b) by 0 days.

(21) Appl. No.: 09/841,542

(22) Filed: Apr. 24, 2001

(65) Prior Publication Data

US 2002/0153135 A1 Oct. 24, 2002

(51) Int. Cl.[7] ..... F21B 37/00

(52) U.S. Cl. ..... 166/249; 166/312; 166/177.7; 166/222

(58) Field of Search ..... 166/249, 311, 166/312, 56, 177.1, 177.7, 222

(56) References Cited

U.S. PATENT DOCUMENTS 5,297,631 A 3/1994 Gipson
5,579,845 A 12/1996 Jansen et al.
5,769,164 A * 6/1998 Archer ..... 166/222
5,836,393 A 11/1998 Johnson
6,029,746 A * 2/2000 Dodd ..... 166/312
6,250,388 B1 6/2001 Carmi et al.

* cited by examiner

*Primary Examiner*—William Neuder
(74) *Attorney, Agent, or Firm*—Shook, Hardy & Bacon L.L.P.

(57) ABSTRACT

A method and apparatus for enhancing the production of newly developed water wells and existing wells that have suffered a reduction in capacity due to plugging. A gas line directs gas under pressure to a relief valve carried in the production string at a location in the production zone of the well. When the applied pressure reaches the pressure setting of the relief valve, the valve opens to apply air sidewardly in bursts which create shock waves to dislodge built up material from the well screen and the surrounding filter pack and formation fractures. Following each burst, the pressure conditions create a flushing effect which draws water back into the well along with the bacteria and particles that were dislodged. A submersible pump or airlift assembly in the production string then delivers the dislodged materials to the surface.

12 Claims, 2 Drawing Sheets

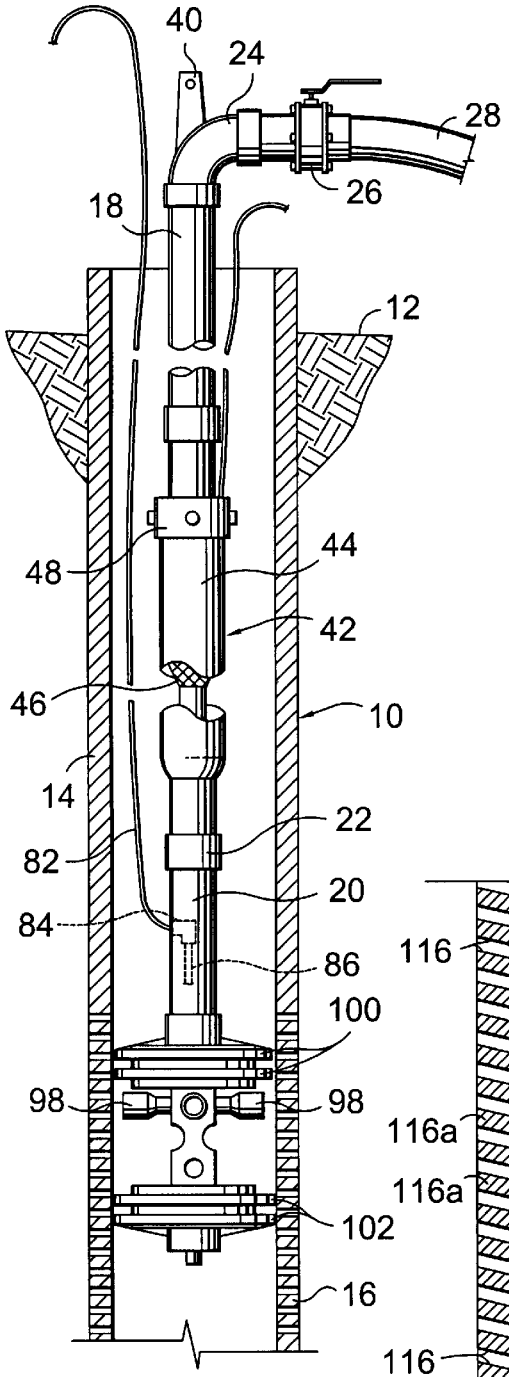
FIG. 2.
FIG. 3.
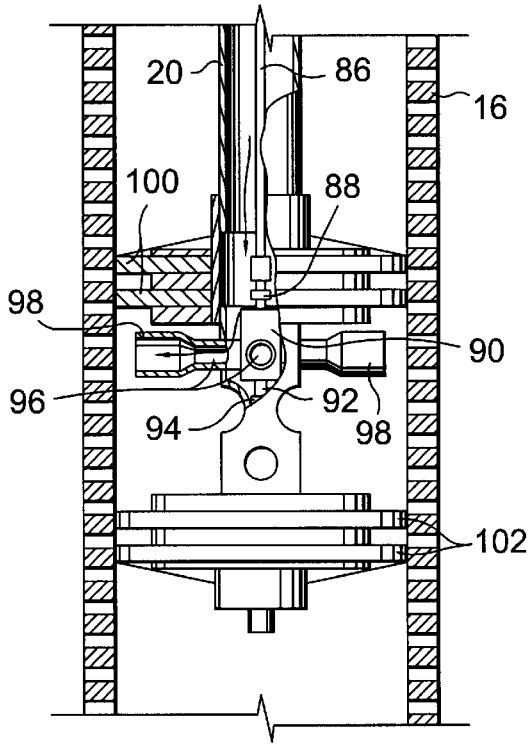
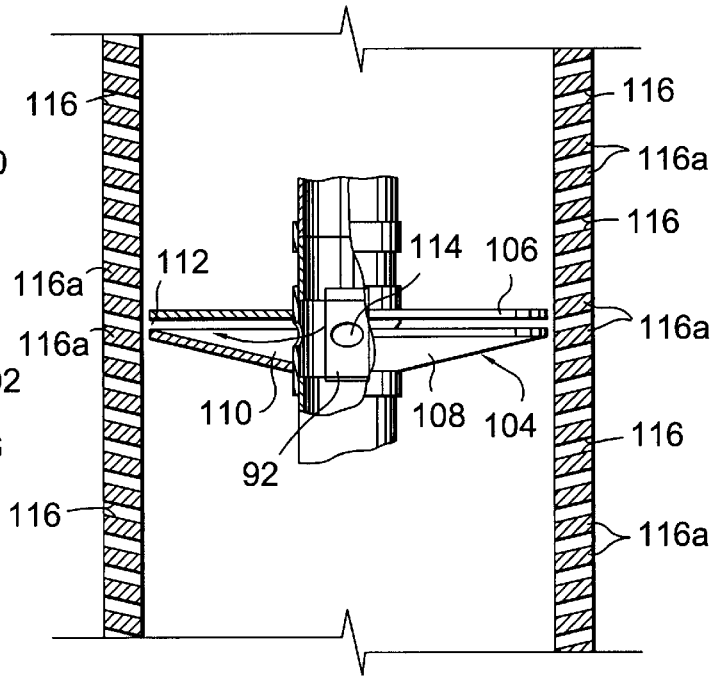
FIG. 4.

METHOD AND APPARATUS FOR STIMULATING WELL PRODUCTION

FIELD OF THE INVENTION

This invention relates generally to water wells and more particularly to a method and apparatus for enhancing development of wells and rehabilitating existing wells that have lost capacity.

BACKGROUND OF THE INVENTION

Water wells and other wells that have been in production for a considerable length of time often lose capacity for a variety of reasons. One of the main reasons is that the well screen and/or the filter pack and surrounding formation fractures tend to become clogged with sand, clay, bacteria and other growths and materials that build up and impede entry of liquid into the well.

Various techniques have been used to restore lost capacity, including chemical injection, mechanical agitation, sonic energy application and electrical stimulation. None of these approaches has been entirely satisfactory. Chemical cleaning methods have typically involved pumping or gravity feeding chemicals into the well. The chemicals follow the path of least resistance which is usually not where the clogging takes place. Thus, conventional chemical injection has not been wholly effective.

Mechanical agitation of the well and screen from the inside dislodges scale and other built up material from the inside of the well. However, it does not affect the filter pack surrounding the well or the fractures in the surrounding formation, so deposit laden areas located outside of the well remain as a source of plugging. The use of sonic energy and electrical energy has been attempted but has not achieved widespread acceptance due largely to cost problems and lack of effectiveness.

SUMMARY OF THE INVENTION

Accordingly, a need remains for an effective way to remove material that clogs wells, well screens, and the surrounding filter pack and fractures, both in newly developed wells and in existing wells that have lost production capacity. It is the primary goal of the present invention to met that need.

In accordance with the invention, gas is applied under pressure in a sidewardly direction in the production zone of a well in controlled bursts. The pressurized gas creates shock waves that cause water and gas to flow outwardly and break down materials that have built up on the screen and also in the surrounding filter pack and formation fractures. At the end of each burst, a flushing effect ensues to draw the loosen particulate material into the well from the surrounding formation. These particles are then removed by a submersible pump or air lift assembly that forces water from the well to the surface. The gas bursts are generated throughout the entirety of the production zone of the well in order to thoroughly clean it and thereby significantly enhance its capacity.

Preferably, the gas bursts are controlled by a relief valve which is positioned down in the well and set to open when subjected to a selected pressure. When the relief valve opens, the gas is discharged sidewardly through side ports or through an open annulus so that the gas is applied directly to the well screen or louvers in a manner to maximize the dislodging of materials that plug the well. Mechanical agitation with agitating discs may be used along with the gas bursts. Chemicals may also be used and are particularly effective because they are carried by the gas outwardly into the formation where they can attack the deposits located there.

BRIEF DESCRIPTION OF THE DRAWINGS

In the accompanying drawings which form a part of the specification and are to be read in conjunction therewith and in which like reference numerals are used to indicate like parts in the various views:

FIG. 2 is a fragmentary sectional view similar to FIG. 1, but showing only part of the system and depicting a submersible pump in the well in place of an air lift assembly;

FIG. 3 is a fragmentary sectional view on an enlarged scale showing the detail identified by numeral 3 in FIG. 1; and FIG. 4 is a fragmentary sectional view on an enlarged scale showing an alternative way of applying gas bursts in accordance with the present invention.

DETAILED DESCRIPTION OF THE INVENTION

Figure 1:
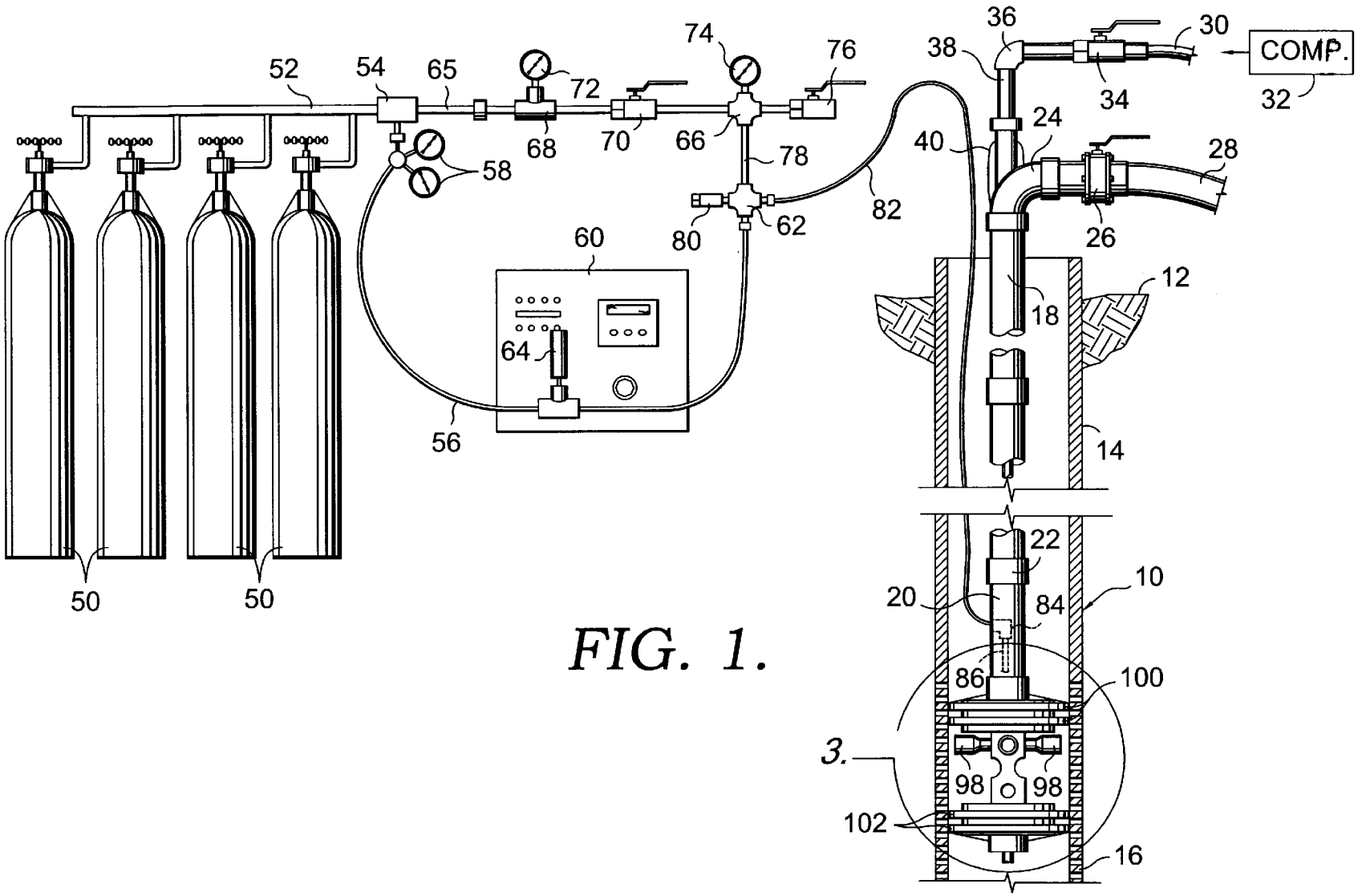
FIG. 1 is a diagrammatic elevational view of a system that may be used to stimulate water well production in accordance with a preferred embodiment of the present invention.

Referring now to the drawings in more detail and initially to FIG. 1, numeral 10 generally designates a well which may be used for the production of water or other fluids. The well 10 is bored into the surface 12 of the earth, and a casing 14 is installed in the well bore in a conventional manner. In the production zone or zones of the well 10, a screen 16 is provided on the casing 14 in order to allow liquid from the surrounding formation to enter the well inside of the casing.

The well 10 is equipped with a production string which includes vertical piping 18 through which liquid from the well is delivered to the surface. A pipe 20 is connected with the lower end of the production piping 18 by a coupling 22. At its upper end, the production piping 18 connects above the surface 12 with an elbow 24. The elbow 24 connects through a valve 26 with a discharge hose 28 used to direct the water or other liquid from the well to a point of further use.

The water that is produced in the well 10 may be raised to the surface through the production string by an air lift assembly that includes an air lift line 30 connected with an air compressor 32. Line 30 connects through a valve 34 with an elbow fitting 36. The fitting 36 connects with a vertical line 38 that extends down through the production piping 18 in order to direct compressed air into the lower portion of the piping 18 to provide an air lift force for raising the water through the piping 18 and the discharge line 28.

The elbow 24 may be provided with a lifting bracket 40 which allows the production piping 18 and the components carried on it to be raised and lowered in the well. A crane or boom (not shown) may be used for lifting of the bracket 40.

FIG. 2 depicts an alternative arrangement in which the air lift assembly is replaced by a submersible pump 42. The pump 42 may be an open or closed impeller pump having a housing 44 carried on the production piping 18 at a location immediately above pipe 20. Within the housing 44, the pump 42 is provided with a screen intake 46. A pump cap 48 is provided at the upper end of the housing 44 where the pump connects with the production piping 18.

In accordance with the present invention, compressed gas is supplied by a suitable source such as a bank of cylinders 50 (FIG. 1) containing a gas under pressure such as air, nitrogen or carbon dioxide. The cylinders 50 connect at their outlets with a supply line 52 leading to a fitting 54. One outlet of the fitting 54 connects with an automatic flow loop 56 equipped with pressure gauges 58 and an automated flow control panel 60. The loop connects with a cross-fitting 62 through a valve 64 which is controlled by the flow control panel 60.

A manually operated flow path is connected with the other outlet of the fitting 54 in order to provide an alternative to the automatic flow control loop 56. A flow line 65 connects with fitting 54 and extends to a cross 66 through a T-fitting 68 and a ball valve 70. The T-fitting 68 is provided with a pressure gauge 72. The cross 66 is similarly provided with a pressure gauge 74. One of the connections for the cross 66 is provided with a ball valve 76. A line 78 leading from the cross 66 to cross 62 provides a flow path along the manually controlled flow line. The cross 62 is provided with a relief valve 80 which opens in the event of application of excessive pressure.

In accordance with a preferred embodiment of the present invention, a flexible hose 82 extends from the outlet side of cross 62 down into the well 10 where it connects with a fitting 84 on the side of pipe 20. The fitting 84 in turn connects with a vertical tube 86 extending downwardly inside of pipe 20. As best shown in FIG. 3, tube 86 connects at its lower end with a bushing 88 on which a valve shroud 90 is carried. The shroud 90 contains a valve 92 which is capped at 94 on its lower end. The shroud 90 is provided with four (4) side ports 96 which are spaced equidistantly around the valve shroud. Gas nozzles 98 are threaded or otherwise secured in the ports 96.

The valve 92 is a relief valve which may be of a type that is available commercially. The relief valve 92 can be set to open when a preset pressure is applied to it. For example, the valve may be set to open at any pressure setting between 50 and 1000 psi above hydrostatic pressure. When closed, the valve 92 is bubble tight to within 5 psi of the set pressure. When the valve 92 is closed, it blocks flow from the gas supply line 86 to the ports 96 and nozzles 98. When line 86 is subjected to a pressure level equal to the setting of valve 92, the valve opens and thereby applies air through ports 96 and 98 in bursts that are applied at the pressure level at which valve 92 is set to open. The flow rate of the bursts may be between 0.3 and 120 cubic feet per second.

The equipment in the well may include a double disk agitator assembly that includes a pair of agitating disks 100 located immediately above the nozzles 98 and another pair of agitators disks 102 located below the nozzles 98. The disks 100 and 102 may be suitably carried on the lower end of the pipe 20. The peripheries of the disks 100 and 102 are adjacent to the inside surface of the casing 14 and screen 16 so that the disks are able to provide mechanical agitation for removing scale and other deposits from the casing and screen.

Normally, liquid flows into the well through screen 16 and is delivered to the surface through the production string 18 by the air lift assembly or the submersible pump 42. When the well becomes clogged to the extent that cleaning is desired, gas is applied from the cylinders 50 and flows to cross 62 along either the automatic flow control loop 56 or the manually controlled flow path provided by lines 65 and 78. The gas is applied under pressure through the hose 82 to tube 86 and then to the relief valve 92 which remains closed until subjected to a pressure that exceeds its preselected pressure setting. When the gas pressure is sufficient to open the relief valve 92, the valve pops open to provide a burst of gas through the nozzles 98 at a pressure equal to the setting of valve 92 and at a volume rate of flow between 0.3 and 20 cfm.

The gas bursts are applied directly to the side through the nozzles 98 to the screen 16. The speed with which the gas is released by valve 92 generates a shockwave and a volume that forces the water outwardly to the side, thereby breaking down any materials that are built up on the screen or in the well, including sand, clay, bacteria, and other growths and materials. The energy of the gas bursts is sufficient to apply a shock wave to the surrounding filter pack and the fractures in the surrounding formation to loosen deposits in these areas as well.

When the valve 92 reseats due to the pressure dropping below the valve setting, the water displaced by the air bursts recovers and creates a flushing effect that draws the loosen particles from the filter pack and the fractures back into the well through the screen 16. These particles are then carried to the surface by the rising gas bubbles or by the operation of the submersible pump 42 or the air lift assembly installed in the well. The sudden change in the water column that is generated by the burst of gas pulls additional particles into the well.

The cleaning assembly including the nozzles 98 is adjusted vertically up and down within the entirety of the production area of the well, and the procedure for cleaning involving the application of gas bursts is repeated so that the entire height of the production zone is subjected to gas bursts, thereby cleaning the entire screen 16 and applying the cleaning technique to the entirety of the producing area or zone of the well 10. The lifting bracket 40 allows a crane or boom to move the cleaning equipment up and down. The entire production zone may be subjected to this cleaning procedure enough times to result in a situation where the discharge water is free of bacteria and/or fine materials built up in the well. The pumping by pump 42 and the air lift created by the air lift assembly, along with the agitation provided by the agitating disks 100 and 102, enhances the ability of the cleaning equipment to dislodge the build up that may be encountered during development of a new well or rehabilitation of an existing well that is plugged. The velocities and pressure changes that result from the cleaning procedure facilitate removal of the materials that are dislodged from the well screen and adjacent areas.

Chemicals may also be injected into the well to enhance the cleaning effect. The chemicals may be applied by know techniques, and the chemicals are forced out through the screen 16 into the surrounding filter pack and formation fractures in order to dislodge materials from these deposit laden areas. The spent chemicals are eventually pumped or air lifted from the well for neutralization and disposal. After the chemicals have been removed, the well may be subjected to additional bursts of air and/or mechanical agitation followed by additional pumping and air lifting until the discharge water is substantially free of all traces of bacteria and particle matter.

FIG. 4 depicts an alternative arrangement that is used primarily for smaller diameter wells and/or wells that are provided with louvers 116 in place of screen 16. Louver openings 116*a* are provided between adjacent louvers 116 which are typically inclined upwardly at an angle from the inside of the casing 14 to the outside of the casing.

In the arrangement shown in FIG. 4, the assembly of the nozzles 98 is replaced with a shroud 104 which includes on its upper portion a horizontal disc 106 and on its lower portion a conical plate 108. The disc 106 and plate 108 are spaced apart to provide an interior chamber 110 between them. The outside edges of disc 106 and plate 108 are adjacent to the casing and louvers 116 and are spaced slightly apart to provide an annular discharge slot 112 through which the gas is applied. The chamber 110 is supplied with gas through ports 114 when the valve 92 is open. The plate 108 inclines upwardly as it extends toward the casing 14 and is preferably oriented at an incline that matches the upward incline of the louvers 116. This allows gas flowing along the upper surface of the plate 108 and through the discharge slot 112 to flow in a direction to readily pass directly through the louver openings 116*a* to enhance removal of materials that may plug one or more of the louver openings.

The arrangement shown in FIG. 4 operates in substantially the same manner described previously. The principal difference is that rather than being discharged at discrete locations defined by the nozzles 98, the gas is applied substantially continuously around the diameter of the well through the discharge slot 112. Additionally, due to the incline of the bottom plate 108, the air discharges from slot 112 at any desired angle matching the incline of the perforated openings 116*a*.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A method of stimulating a well having a producing area, comprising the steps of:

directing a selected gas into the well at a preselected pressure;

directing the gas generally sidewardly in the producing area of the well in sequential bursts effective to generate a shock wave for breaking up materials that have built up in and adjacent to the well;

mechanically agitating the well; and varying the location at which the gas is directed generally sidewardly in a manner to direct the gas generally sidewardly throughout substantially the entirety of the producing area.

2. A method as set forth in claim 1, wherein the gas is directed generally sidewardly at a pressure in the range of approximately 50 to 1000 psi above hydrostatic pressure.

3. A method as set forth in claim 2, wherein the gas is directed generally sidewardly at a volume rate of flow in the range of approximately 0.3 to 120 cubic feet per second.

4. A method as set forth in claim 1, wherein the gas is directed generally sidewardly at a volume rate of flow in the range of approximately 0.3 to 120 cubic feet per second.

5. A method as set forth in claim 1, including the step of providing a relief valve in the well having a setting to open when subjected to said preselected pressure and arranged when open to direct the gas generally sidewardly.

6. A method as set forth in claim 1, including the step of injecting cleaning chemicals into the well.

7. Apparatus for stimulating flow in a producing area of a well, comprising:

a production string in the well for receiving liquid in the well, said production string extending to the producing area;

a gas line extending to the producing area of the well for supplying gas;

an outlet port in said production string for receiving gas from said gas line and directing the gas generally sidewardly in the producing area;

a relief valve for controlling flow from the gas line to said port, said valve opening at a selected pressure applied thereto in said gas line;

a gas supply for applying gas to the gas line at said selected pressure in sequential bursts to discharge the gas generally sidewardly through said port in sequential bursts effective to generate a shock wave for breaking up materials in and adjacent to the producing area of the well; and a mechanical agitator carried on said production string adjacent to said outlet port for mechanically agitating the well.

8. Apparatus as set forth in claim 7, wherein:

said well includes inclined louvers in the producing area; and said port comprises an annular slot oriented at an incline to direct the gas toward the louvers at an incline substantially the same as the incline of the louvers.

9. In combination with a production string in a water well having a production zone and inclined louvers in the production zone:

a supply of gas under pressure;

a gas line extending from said supply to the production zone, said gas line being connected with the production string;

an outlet port for directing gas generally sidewardly in the production zone, said port comprising an annular slot oriented at an incline to direct gas passing through said slot toward the louvers at an incline substantially the same as the incline of the louvers;

a relief valve having an open position connecting said gas line with said port and a closed position blocking flow from said line to said port, said relief valve opening when gas in said line is applied to the valve at a selected pressure; and a control for applying gas from said supply to said line in sequential bursts at said selected pressure, thereby sequentially opening said relief valve to discharge the gas through said port in bursts effective to generate a shock wave for breaking up material build up in and adjacent to said production zone.

10. Apparatus as set forth in claim 9, including a mechanical agitator carried on said production string adjacent to said outlet port for mechanically agitating the well.

11. In combination with a production string in a water well having a production zone:

a supply of gas under pressure;

a gas line extending from said supply to the production zone, said gas line being connected with the production string;

an outlet port for directing gas generally sidewardly in the production zone;

a relief valve having an open position connecting said gas line with said port and a closed position blocking flow from said line to said port, said relief valve opening when gas in said line is applied to the valve at a selected pressure;

a control for applying gas from said supply to said line in sequential bursts at said selected pressure, thereby sequentially opening said relief valve to discharge the gas through said port in bursts effective to generate a shock wave for breaking up material build up in and adjacent to said production zone; and a mechanical agitator carried on said production string adjacent to said outlet port for mechanically agitating the well.

12. Apparatus for stimulating flow in a producing area of a well, comprising:

a production string in the well for receiving liquid in the well, said production string extending to the producing area;

a gas line extending to the producing area of the well for supplying gas;

a plurality of nozzles carried on said production string for receiving gas from said gas line and directing the gas generally sidewardly in the producing area;

a relief valve for controlling flow from the gas line to said nozzles, said valve opening at a selected pressure applied thereto in said gas line;

a gas supply for applying gas to the gas line at said selected pressure in sequential bursts to discharge the gas generally sidewardly through said nozzles in sequential bursts effective to generate a shock wave for breaking up materials in and adjacent to the producing area of the well; and at least a pair of disks carried on said production string at respective locations above and below said nozzles with said disks having peripheries adjacent to the well to concentrate the force of said bursts to the area between said disks.

* * * * *